US011905784B2

(12) United States Patent
Chiverton

(10) Patent No.: US 11,905,784 B2
(45) Date of Patent: Feb. 20, 2024

(54) ROTATABLE WELLHEAD AND CENTRALIZER

(71) Applicant: AS INNOVATIVE HOLDINGS PTY LTD, Brisbane (AU)

(72) Inventor: Kieran Chiverton, Dalby (AU)

(73) Assignee: AS Innovative Holdings Pty Ltd, Brisbane (AU)

( * ) Notice: Subject to any disclaimer, the term of this patent is extended or adjusted under 35 U.S.C. 154(b) by 0 days.

(21) Appl. No.: 17/909,588

(22) PCT Filed: Mar. 5, 2021

(86) PCT No.: PCT/AU2021/050195

§ 371 (c)(1),
(2) Date: Sep. 6, 2022

(87) PCT Pub. No.: WO2021/174313

PCT Pub. Date: Sep. 10, 2021

(65) Prior Publication Data

US 2023/0109838 A1 Apr. 13, 2023

(30) Foreign Application Priority Data

Mar. 6, 2020 (AU) ..... 2020900706

(51) Int. Cl.
*E21B 33/04* (2006.01)
*E21B 17/10* (2006.01)

(52) U.S. Cl.
CPC ..... *E21B 33/0415* (2013.01); *E21B 17/1078* (2013.01)

(58) Field of Classification Search
CPC ..... E21B 33/0415; E21B 17/1078
See application file for complete search history.

(56) References Cited

U.S. PATENT DOCUMENTS 1,566,451 A 12/1925 Vaughn
2,294,061 A 8/1942 Williamson
(Continued)

FOREIGN PATENT DOCUMENTS

CA 2 942 495 A1 3/2018
FR 2 542 367 A1 9/1984
(Continued)

OTHER PUBLICATIONS

Graham, M. et al., "Tubing rotator reduces tubing wear in rod pumped wells", Oil and Gas Journal, 1994, vol. 92, pp. 52-54.
(Continued)

*Primary Examiner* — Aaron L Lembo
(74) *Attorney, Agent, or Firm* — Brooks Kushman P.C.

(57) ABSTRACT

Disclosed is a wellhead that includes a casing head, a tubing hanger and a rotation assembly connected to the tubing hanger. The tubing hanger is rotatable relative to the casing head and this rotation is effected by the rotation assembly. Also disclosed is a centraliser for use with tubing in a well. The centraliser has a first sleeve, a second sleeve, and a body that has a first band and a second band connected by a number of resiliently deformable members. The bands extend about the sleeves, with the bands being able to move relative to the respective sleeves. This can permit the centraliser to be fitted to tubing without requiring tight tolerances of tubing size, for example, and may reduce the friction between the body and the tubing to allow the tubing to be rotated within the casing during use.

10 Claims, 8 Drawing Sheets

(56) References Cited

U.S. PATENT DOCUMENTS

| | | | | |
|---|---|---|---|---|
| 2,630,181 | A | 3/1953 | Solum | |
| 2,694,450 | A | 11/1954 | Osbun | |
| 5,139,090 | A | 8/1992 | Land | |
| 10,934,800 | B2 * | 3/2021 | Hatten | E21B 33/04 |
| 2002/0121367 | A1 | 9/2002 | Meek et al. | |
| 2003/0024709 | A1 * | 2/2003 | Cuppen | E21B 33/0415 166/85.4 |
| 2003/0150611 | A1 | 8/2003 | Buytaert | |
| 2012/0085552 | A1 | 4/2012 | Travis et al. | |
| 2013/0248206 | A1 | 9/2013 | Jordan et al. | |
| 2015/0021047 | A1 | 1/2015 | Buytaert et al. | |
| 2017/0198533 | A1 | 7/2017 | Robichaux et al. | |

FOREIGN PATENT DOCUMENTS

| | | | |
|---|---|---|---|
| FR | 2 554 160 | A1 | 5/1985 |
| GB | 2 249 333 | A | 5/1992 |

OTHER PUBLICATIONS

PCT International Search Report, dated Jun. 1, 2021, Application No. PCT/AU2021/050195, Applicant as Innovatie Holdings Pty Ltd, 11 Pages.

PCT International Preliminary Report on Patentability, dated Sep. 6, 2022, Application No. PCT/AU2021/050195, Applicant as Innovatie Holdings Pty Ltd, 14 Pages.

* cited by examiner

ROTATABLE WELLHEAD AND CENTRALIZER

CROSS-REFERENCE TO RELATED APPLICATIONS

This application is the U.S. national phase of PCT Application No. PCT/AU2021/050195 filed on Mar. 5, 2021, which claims priority to Australian Patent Application No. 2020900706 filed on Mar. 6, 2020, the disclosures of which are incorporated in their entireties by reference herein.

BACKGROUND OF THE INVENTION

The present invention generally relates to equipment and methods used in wells, such as oil and/or gas wells including wells for various services for mining such as pastefill, and more particularly to wellheads and casing and tubing, and methods of operating such equipment.

Prior Application

The present application claims priority from Australian Provisional Patent Application Number 2020900706, the contents of which is hereby included in its entirety.

Description of the Prior Art

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

Casing and tubing used in a typical well can often be used for conveying material that is particularly abrasive. For example, the casing and tubing may be used to move drilling mud or slurries that can be made up of a wide variety of products, which can include abrasive components such as sand or rock fragments. In another example, at the end of the life of a well or to fill an underground void or space (mining backfill), it may be desirable to pump concrete down into the well through the casing and tubing. Again, this can be a highly abrasive material.

While it is generally desirable for a well bore to be vertical, the practical reality of drilling often results in this not being the case. When this occurs, abrasive material passing through the inclined casing or tubing results in one side of the casing or tubing being subject to higher wear, due to the effects of gravity. That is, the bottom side of the inclined casing or tubing wears more than the top side. This differing rate of wear can be further exacerbated if the material passing through the casing or tubing only partially fills the casing or tubing, resulting in significant wear on one side of the casing or tubing and virtually no wear on the opposite side.

Despite casing and tubing typically being made from thick-walled steel, the wear can be significant enough over time to cause a failure in the wall of the casing and tubing. However, the wear rates are not always predictable and typically can't be measured, making predicting these failures very difficult. As a result, casing and tubing can fail unexpectedly, leading to significant unplanned down time of the well operation. Additionally, in a situation where cement is being transported through the casing and tubing, this can result in cement filling the casing, potentially requiring complete redrilling of the well, which is extremely costly.

Replacement of the casing or tubing periodically is possible, however this is still a time consuming and costly operation. Therefore, this is not a task that is desirable to undertake if it is not necessary. As such, it is desirable to provide a means for increasing the life of the casing or tubing, or at least better predicting the wear rates or otherwise addressing the problems of the prior art.

SUMMARY OF THE PRESENT INVENTION

According to a broad form of the invention, there is provided a wellhead, comprising:

a) a casing head;

b) a tubing hanger; and c) a rotation assembly connected to the tubing hanger;

wherein the tubing hanger is rotatable relative to the casing head and this rotation is effected by the rotation assembly.

In an embodiment, the rotation assembly is connected between the casing head and the tubing hanger.

In an embodiment, the rotation assembly comprises a linear actuator.

In an embodiment, the linear actuator is pivotally connected to the tubing hanger in a manner that allows the location of the connection to be adjusted around a circumference of the tubing hanger.

In an embodiment, the tubing hanger comprises a peripheral groove, wherein a tab of the rotation assembly is inserted in the groove for connection of the rotation assembly to the tubing hanger.

In an embodiment, the tubing hanger has a plurality of holes for securing the tab of the rotation assembly in one of a plurality of positions within the groove.

In an embodiment, the rotation assembly comprises a gear mechanism.

In an embodiment, a bearing is disposed between the casing head and the tubing hanger.

In an embodiment, a seal is disposed between the casing head and the tubing hanger.

In an embodiment, the tubing hanger comprises a conduit that extends through the tubing hanger and allows fluid communication through the tubing hanger to a void between the casing and the tubing.

According to another broad form of the invention, there is provided a centraliser for use with tubing in a well, the centraliser comprising:

a) a first sleeve and a second sleeve;

b) a body comprising a first band and a second band connected to one another by a plurality of resiliently deformable members;

wherein the first band extends about the first sleeve and the second band extends about the second sleeve, and wherein the bands are able to move relative to the respective sleeves.

In an embodiment, the sleeves each comprise a collar to limit movement of the band along the sleeve.

In an embodiment, the sleeves comprise one or more through holes with grub screws fitted therein, such that the sleeves can be fitted over and secured to the tubing.

In an embodiment, a bearing is disposed between each of the bands and the respective sleeve that allows both rotational and longitudinal relative movement.

In an embodiment, the bearings are in the form of ball bearings retained in a groove on an inside surface of each of the bands.

According to another broad form of the invention, there is provided a centraliser for use with tubing in a well, the centraliser comprising a body comprising a first band and a second band connected to one another by a plurality of resiliently deformable members, wherein the first band and the second band are configured to extend about the tubing, and wherein a bearing is disposed on inside surface of each of the bands that allows both rotational and longitudinal relative movement between the bands and the tubing.

In an embodiment, the bearings are in the form of ball bearings retained in a groove on an inside surface of each of the bands.

In an embodiment, in use a collar is fitted to the tubing on one or both sides of the centraliser to limit movement of the bands along the tubing.

According to another broad form of the invention, there is provided a well tubing system, comprising a wellhead substantially as defined herein, and tubing suspended from the wellhead.

In an embodiment, the well tubing system further comprises one or more centralisers fitted to the tubing, the centralisers being substantially as defined herein.

According to another broad form of the invention, there is provided a method of operating a well, the well comprising casing, a wellhead connected to the casing, and tubing within the casing suspended from the wellhead, the method comprising the steps of:

i) operating the well for a period of time; and ii) rotating the tubing.

In an embodiment, the tubing is rotated periodically.

In an embodiment, the step of rotating the tubing comprises the substeps of:

i) extending an actuator of a rotation assembly that is connected to a tubing hanger;

ii) disconnecting the rotation assembly from the tubing hanger;

iii) contracting the actuator; and iv) reconnecting the rotation assembly to the tubing hanger.

In an embodiment, the step of rotating the tubing comprises the substeps of:

i) contracting an actuator of a rotation assembly that is connected to a tubing hanger;

ii) disconnecting the rotation assembly from the tubing hanger;

iii) extending the actuator; and iv) reconnecting the rotation assembly to the tubing hanger.

It will be appreciated that the broad forms of the invention and their respective features can be used in conjunction and/or independently, and reference to separate broad forms is not intended to be limiting. Furthermore, it will be appreciated that features of the method can be performed using the system or apparatus and that features of the system or apparatus can be implemented using the method.

BRIEF DESCRIPTION OF THE DRAWINGS

Various examples and embodiments of the present invention will now be described with reference to the accompanying drawings, in which:—

DETAILED DESCRIPTION OF THE PREFERRED EMBODIMENTS

Figure 1:
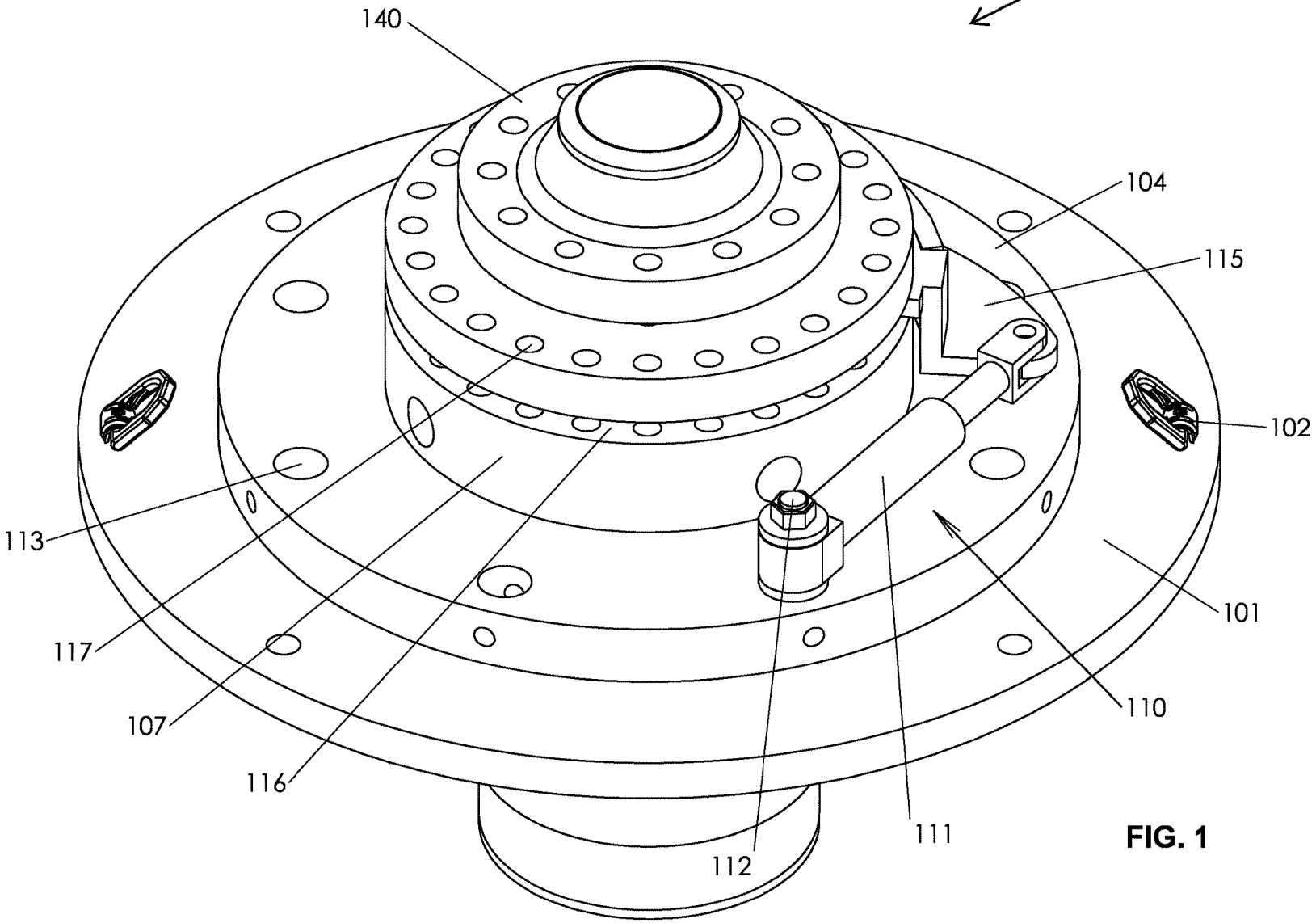
FIG. 1 is an isometric view of a wellhead according to an embodiment of the invention.

An example of a wellhead according to an embodiment of the invention will now be described. The wellhead has a casing head attached to an upper end of a well casing and a tubing hanger that is connected to tubing located within the casing.

The casing and tubing used in the well may be any suitable design. For example, the casing may typically be sections of steel pipe that are inserted to the well bore, and may be cemented in place by filling any space between the well bore and the outside of the casing. The tubing may also be formed from connected sections of steel tube, with the tubing being situated inside the casing and having an annular space between the tubing and the casing.

It will be appreciated that the tubing and/or casing may be supported from the bottom of the well, in addition or instead of being supported from the top of the well. In this sense, the term "hanger" such as used in relation to the tubing hanger is to be construed in a broad sense, in that it may simply hold the tubing in position rather than supporting the entire weight of the tubing. Therefore, throughout the specification, it will be understood that the tubing and/or casing described may be supported from either or both of the top and bottom of the well.

The wellhead includes a rotation assembly that is connected to the tubing hanger. The rotation assembly can be used to rotate the tubing hanger relative to the casing head. As the tubing is connected to the tubing hanger, this in turn results in the tubing being rotated within the casing.

Allowing the tubing to be rotated in this way is advantageous, as it can allow the life of the tubing to be prolonged. As discussed above, movement of abrasive materials through the tubing can result in the bottom side of the tubing wearing significantly more than the top side. However, by rotating the tubing, this wear can be spread more evenly around the circumference of the tubing, dramatically increasing the time before a failure of the tubing.

Other optional and/or advantageous embodiments of the wellhead will now be described.

The rotation assembly may be connected between the casing head and the tubing hanger. In alternative embodiments, however, the rotation assembly may extend from the tubing hanger to some other suitable component or location, such as a base plate of the wellhead, for example.

Preferably, the rotation assembly uses a linear actuator to effect the movement of the tubing hanger. The linear actuator will typically be a hydraulic ram, but may alternatively be any suitable device as will be known to those skilled in the art, such as but not limited to a pneumatic or electric ram.

The linear actuator may preferably be pivotally connected to the tubing hanger in a manner that allows the location of the connection to be adjusted around a circumference of the tubing hanger. For example, the tubing hanger may be formed with a peripheral groove, so that a tab of the rotation assembly can be inserted in the groove for connection of the rotation assembly to the tubing hanger. In such an example, the tubing hanger could also have a plurality of holes spaced around the length of the groove for securing the tab of the rotation assembly in one of a plurality of positions within the groove. In another similar example, the tubing hanger could have angled slots rather than holes, which receive pins of the rotation assembly, thereby forming a ratchet-like connection.

In an alternative embodiment, the rotation assembly may use a gear mechanism to effect the movement of the tubing hanger. For example, the tubing hanger may have teeth around an outer circumference, which can mesh with and be rotated by a smaller gear operated by a motor, with or without an additional gearing and/or clutches. Of course, it will be appreciated that many other forms of gear mechanism may also be used.

To aid with rotation of the tubing hanger, a bearing can be disposed between the casing head and the tubing hanger. For example, a thrust bearing may be placed between an upper surface of the casing head and a lower surface of the tubing hanger. This bearing may be partially embedded in one or both of these surfaces. It will be appreciated by persons skilled in the art that various forms of bearings are broadly suitable for this purpose.

Additionally, or alternatively, a seal can also be disposed between the casing head and the tubing hanger. For example, in the case where a bearing is used, an O-ring could also be positioned inside and/or outside of the bearing.

In one example embodiment, the tubing hanger may have one or more conduits that extend through the tubing hanger and allow fluid communication through the tubing hanger to a void between the casing and the tubing. This space outside the tubing is typically not utilised, however providing such a conduit through the tubing hanger to allow access to this space may be useful in some situations, such as in the event of tubing failure. In another example, access to this void through the conduit may be used to monitor any change in communication such as an increase or reduction in pressure.

Typically, the tubing does not sit exactly central within the casing. As such, attempts to rotate the tubing as described above may be resisted by friction between the tubing and the casing. However, as the tubing is typically not designed to have large rotational forces applied, it may not be possible to rotate the tubing from the upper or lower end.

Accordingly, a centraliser that holds the tubing centred within the casing but also allows rotation of the tubing may be required in some situations. An example of such a centraliser will now be described.

The centraliser has a first sleeve and a second sleeve. It also has a body with a first band and a second band that are connected to one another by a plurality of resiliently deformable members. The first band extends about the first sleeve and the second band extends about the second sleeve.

The bands are able to move relative to the respective sleeves. In this way, the sleeves can be fitted over the tubing and do not need to be able to move relative to the tubing. Instead, the sleeves provide a surface within sufficient tolerance so that the bands are able to move over these surfaces of the sleeves.

The deformable members can be outwardly bowed strips, such as are known to be used in prior art centralisers, which allow the centraliser to abut the inside of the casing and bend to accommodate variations in diameter and also to allow some movement of the tubing during use.

While prior art centralisers may be designed to allow some movement between the centraliser and the tubing, this is typically only sufficient to allow for the bending of the bowed strips during use. That is, the tolerances used and designs would allow limited movement, but still require overcoming significant friction. Therefore, an operation like rotation of the tubing may still not be possible, as the combined friction of many of these prior art centralisers would combine to be too great for the tubing to withstand when rotation is attempted from an upper end.

The present embodiment of centraliser described above is advantageous because it greatly reduces this friction, meaning rotation of the tubing becomes possible. It also achieves this using standard tubing, without any modification necessary, even if the outer surface of the tubing is not a consistent enough diameter and/or not a smooth surface.

Other optional and/or advantageous embodiments of the centraliser will now be described.

The sleeves may each comprise a collar to limit movement of the band along the sleeve. For example, the collars may be provided at outer ends of the sleeves so that the bands cannot move beyond the ends of the sleeves. Alternatively, it may be possible to place collars at inner ends of the sleeves to achieve the same result.

It is preferable for the sleeves to be able to be secured to the tubing. In one example, this may be achieved by providing the sleeves with one or more through holes with grub screws fitted therein. This can allow the sleeves to be fitted over the tubing and secured in place by tightening the grub screws into the sides of the tubing.

To aid with movement of the bands on the sleeves, a bearing can be disposed between each of the bands and the respective sleeve. These bearings preferably allow both rotational and longitudinal relative movement. This means that lateral movement of the tubing due to bending of the deformable members can be accommodated by the bands sliding along the sleeves in a longitudinal direction, while rotation of the tubing is also possible by allowing the sleeves to move in a rotational direction within the bands.

In one example, the bearings may be in the form of ball bearings retained in a groove on an inside surface of each of the bands. It will be appreciated, however, that alternative forms of bearing may be known to those skilled in the art and could also be used in the present situation.

In some situations, an alternative embodiment of a centraliser may be suitable. This alternative centraliser may have a body with a first band and a second band connected to one another by a plurality of resiliently deformable members, where the first band and the second band are fitted directly over the tubing. A bearing can be disposed on inside surface of each of the bands, allowing both rotational and longitudinal relative movement between the bands and the tubing.

As noted above, the outside surface of the tubing may not be particularly smooth or consistent in diameter, so it may be necessary to have slightly oversized components of the centraliser to account for these poor tolerances. In one example, the bearings may be in the form of ball bearings retained in a groove on an inside surface of each of the bands. Similarly, it may be beneficial to have large sized ball bearings in order to accommodate the variations in the outer surface of the tubing.

Advantageously, in some embodiments a collar can be fitted to the tubing on one or both sides of the centraliser to limit movement of the bands along the tubing. These collars may be broadly similar to the sleeves described previously, but rather than the bands extending about the sleeves, the bands will abut the collar to limit movement in a particular direction.

It will be appreciated that the centraliser as described above could be used together with the wellhead as described, but may also be used with some alternative wellheads that may or may not allow rotation of the tubing. Similarly, the wellhead as described could be used with the centraliser as described, but may also be used separately or with alternative designs of centraliser. Each of the wellhead and the centraliser are devices that allow an operation to be performed where the tubing in a well can be rotated.

Advantageously, however, a well tubing system may include a wellhead as described above with tubing suspended from the wellhead, as well as one or more centralisers fitted to the tubing, where the centralisers are also as described above. Such a well tubing system can be used to perform a method of operating a well, an example of which will now be described.

The method of operating a well can include the steps of operating the well for a period of time and rotating the tubing. For example, the tubing could be rotated periodically to distribute the wear of the tubing as evenly as possible.

The step of rotating the tubing may involve extending an actuator of the rotation assembly that is connected to a tubing hanger, disconnecting the rotation assembly from the tubing hanger, contracting the actuator, and reconnecting the rotation assembly to the tubing hanger. Alternatively, the step of rotating the tubing may involve contracting the actuator of the rotation assembly, disconnecting the rotation assembly from the tubing hanger, extending the actuator, and reconnecting the rotation assembly to the tubing hanger.

When the tubing is rotated from the top by the wellhead in this way, the centralisers may be used to hold the tubing centrally within the casing. As described above, the centralisers provide means for the tubing to rotate with reduced resistance from contact with the casing.

An example embodiment of a wellhead will now be described with reference to FIGS. 1 to 4.

Referring to FIG. 1, a wellhead 100 is shown that includes abase plate 101 with lifting points 102. A casing head 104 is fitted to the base plate 101 and a tubing hanger 107 is fitted to the casing head 104.

A rotation assembly 110 includes a hydraulic actuator 111 pivotally connected at one end to the casing head 104. This connection is achieved by a bolt 112 inserted through and into a hole 113 in the casing head 104. At the other end, the actuator 111 is connected to the tubing hanger 107 by a bracket 115. The bracket 115 fits into a groove 116 of the tubing hanger 107 and is secured in place using one or more holes 117 in the tubing hanger 107 and a fastener (not shown).

It will be appreciated that extending or contracting the actuator 111 causes the tubing hanger 107 to rotate relative to the casing head 104. When the actuator 111 reaches the end of its travel, the bracket 115 can be disconnected from the tubing hanger 107, moved along the groove 116, and fixed in a different location.

For example, extension of the actuator 111 will cause rotation of the tubing hanger 107 in a counter-clockwise direction. The bracket 115 can then be disconnected and the actuator 111 retracted, causing the bracket 115 to move along the groove 116 in a clockwise direction. The bracket 115 can then be reconnected to the tubing hanger 107 to either fix it in position or for further rotation. It will be appreciated that the reverse actions could also be used for rotation in the opposite direction.

Figure 2:
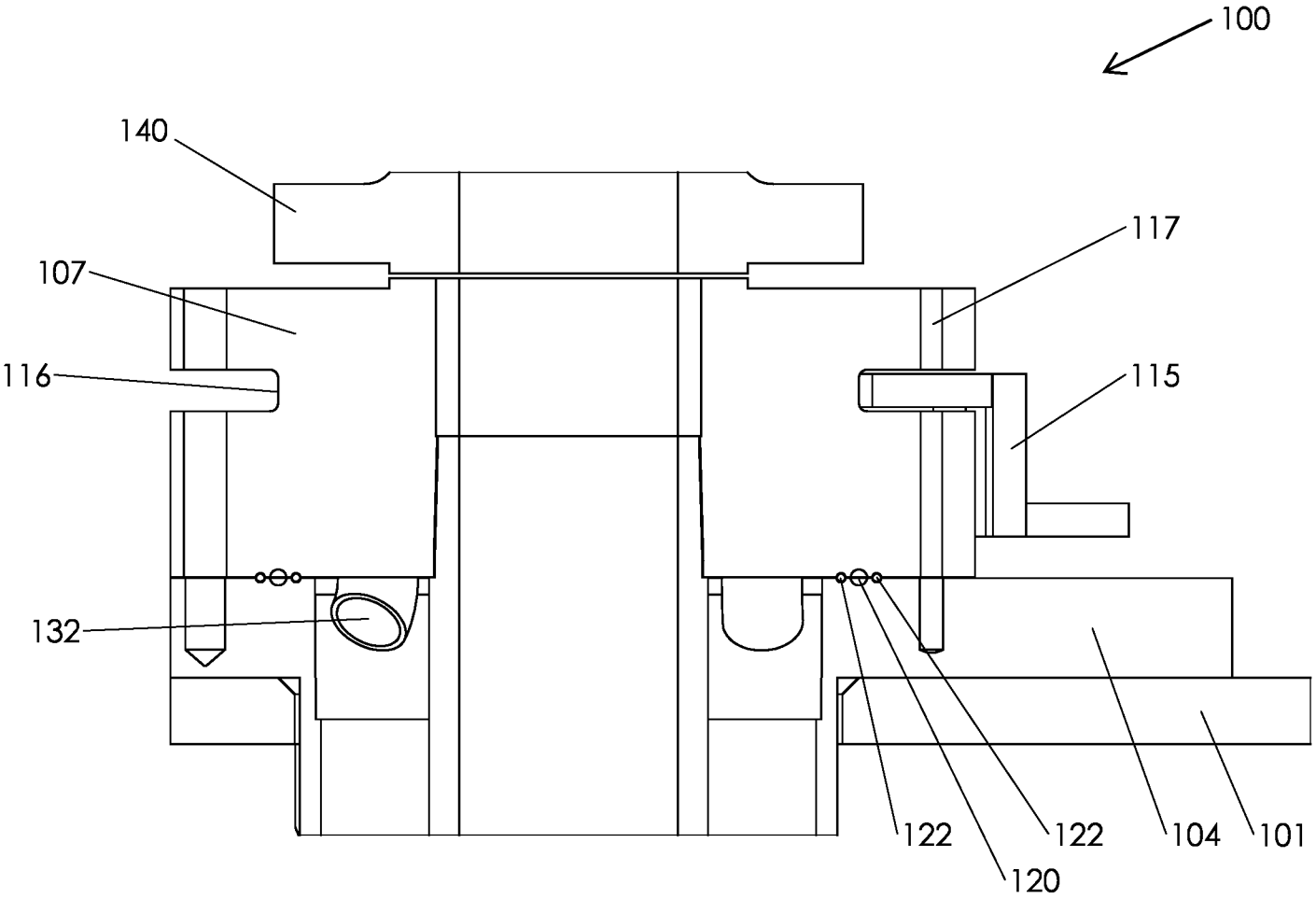
FIG. 2 is a cross sectional side view of the wellhead from FIG. 1.

Referring to FIG. 2, a bearing 120 is located between the casing head 104 and the tubing hanger 107, allowing the relative rotation to occur more easily. This bearing 120 is in the form of ball bearings situated in cooperating grooves, however it will be appreciated that other forms of thrust bearing could also be used. An O-ring type seal 122 is also located on either side of the bearing 120.

Tubing 108 is fixed to and suspended from the tubing hanger 107. Similarly, casing 109 extends downwardly from the casing head 104, with a space 124 being located between the tubing 108 and the casing 109.

Figure 3:
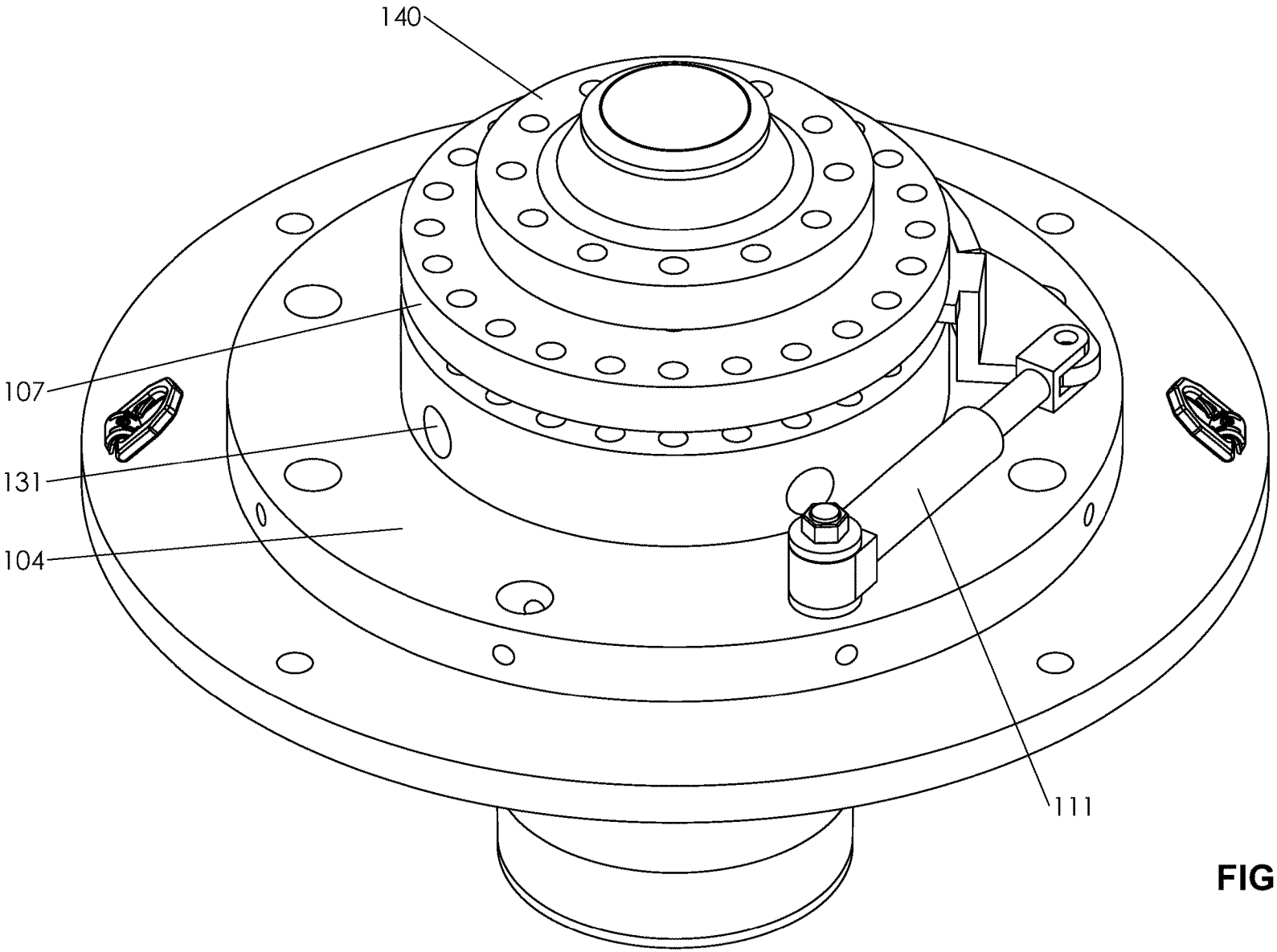
FIG. 3 is another isometric view of the wellhead from FIG. 1.
Figure 4:
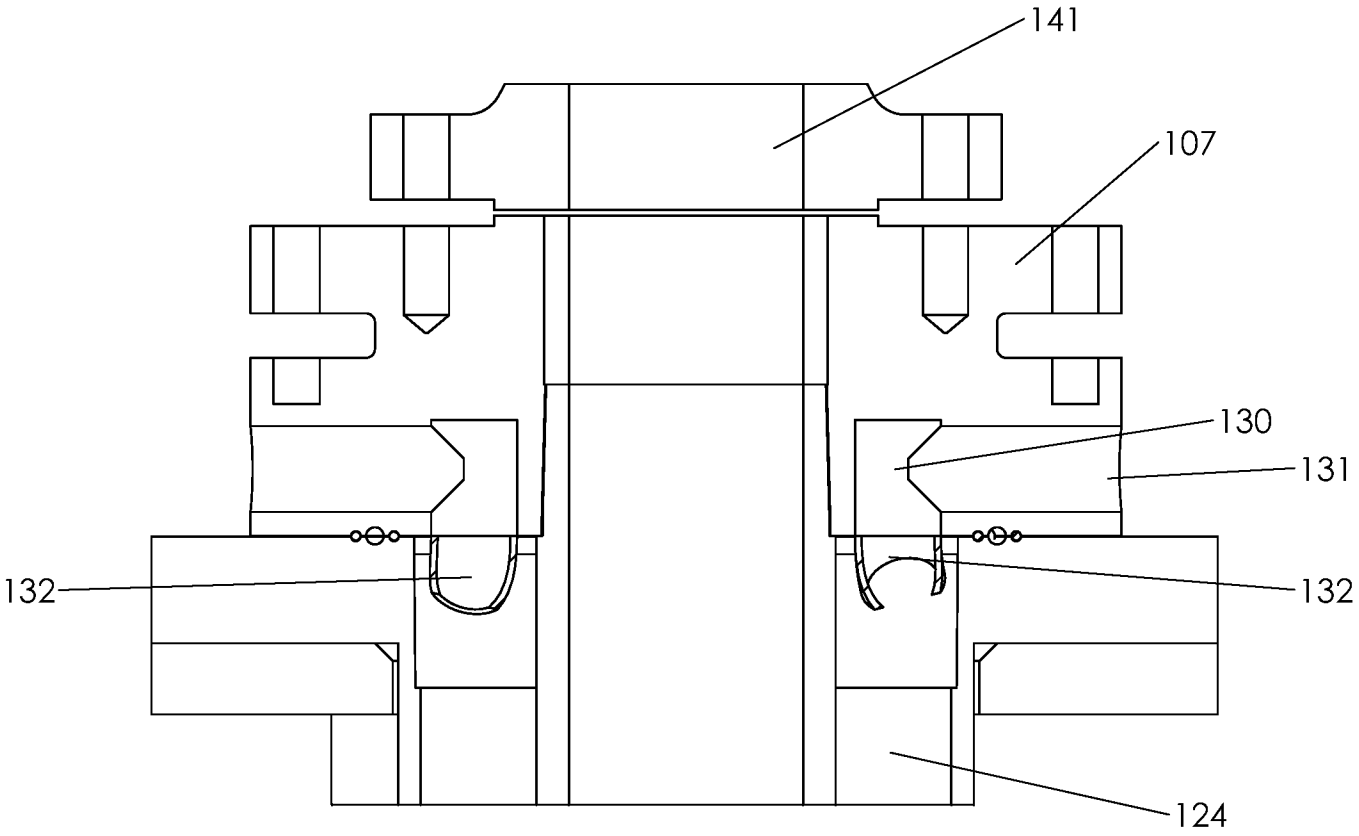
FIG. 4 is a cross sectional side view of the wellhead from FIG. 1.

Referring to FIGS. 3 and 4, a number of conduits 130 extend through the tubing hanger 107, each connecting a port 131 at a location above the casing hanger 104 to an opening 132 in the space 124 between the casing 109 and the tubing 108. That is, the conduit 130 allows fluid communication through the tubing hanger 107 to the space immediately outside the tubing 108, or immediately inside the casing 109.

The tubing 108 is in fluid communication with an upper flange 140 a central void 141. Rotation of the tubing hanger 107 occurs without any corresponding rotation of the upper flange 140. This flange 140 provides a connection point for associated above-ground or below-ground equipment. As such, the rotation of the tubing hanger 107 and tubing 108 occurs without any effect on or necessary modification to the incoming/outgoing connection.

An example embodiment of a centraliser will now be described with reference to FIGS. 5 to 8.

Figure 5:
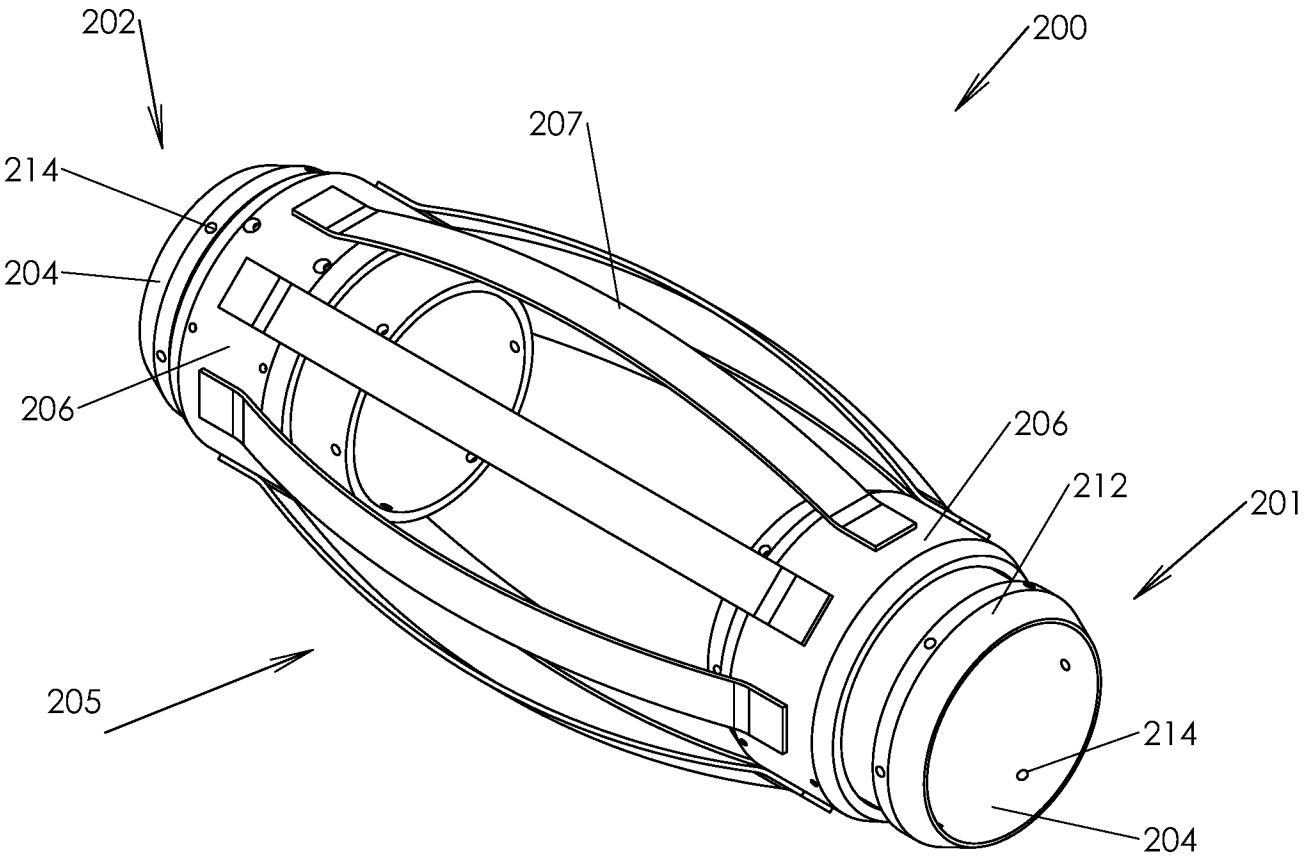
FIG. 5 is an isometric view of a centraliser according to an embodiment of the invention.
Figure 6:
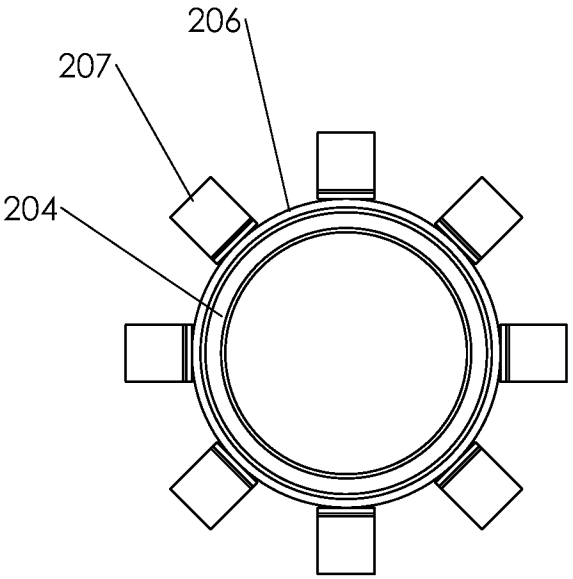
FIG. 6 is an end view of the centraliser from FIG. 5.
Figure 7:
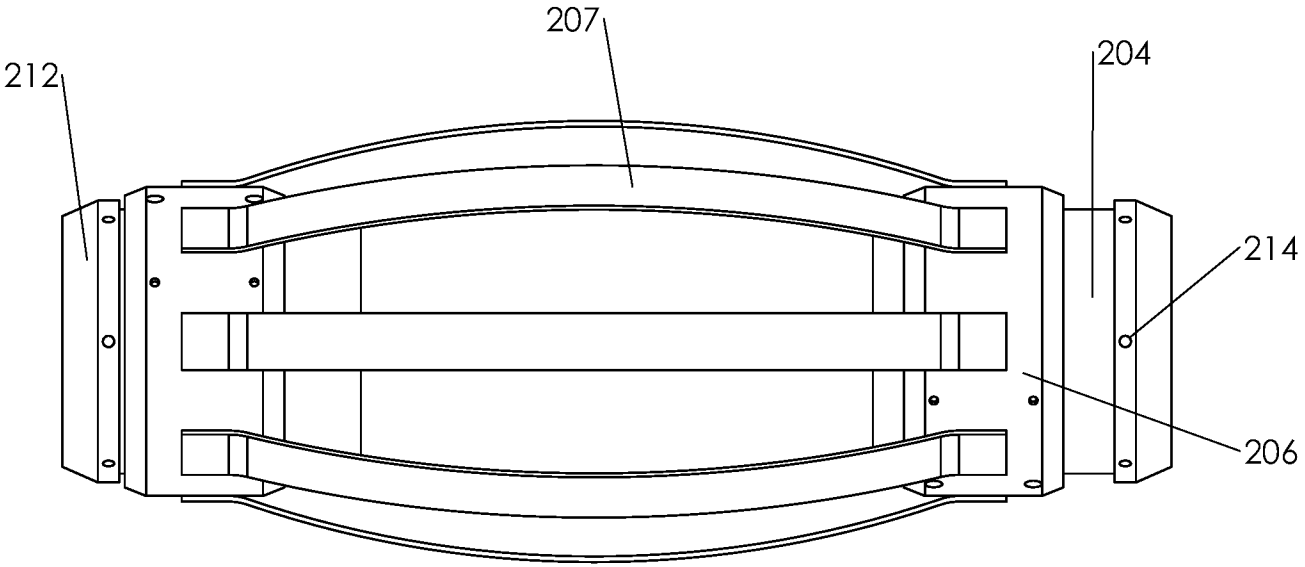
FIG. 7 is a side view of the centraliser from FIG. 5.

Referring to FIG. 5, a centraliser 200 is shown that has a first end 201 and a second end 202, with a sleeve 204 located at each of the ends. A body 205 of the centraliser 200 extends between the sleeves 204 and includes a band 206 at each end fitted over each of the sleeves 204. A number of resiliently deformable members 207 extend between the bands 206 and are bowed outwardly relative to a longitudinal axis of the centraliser 200.

Figure 8:
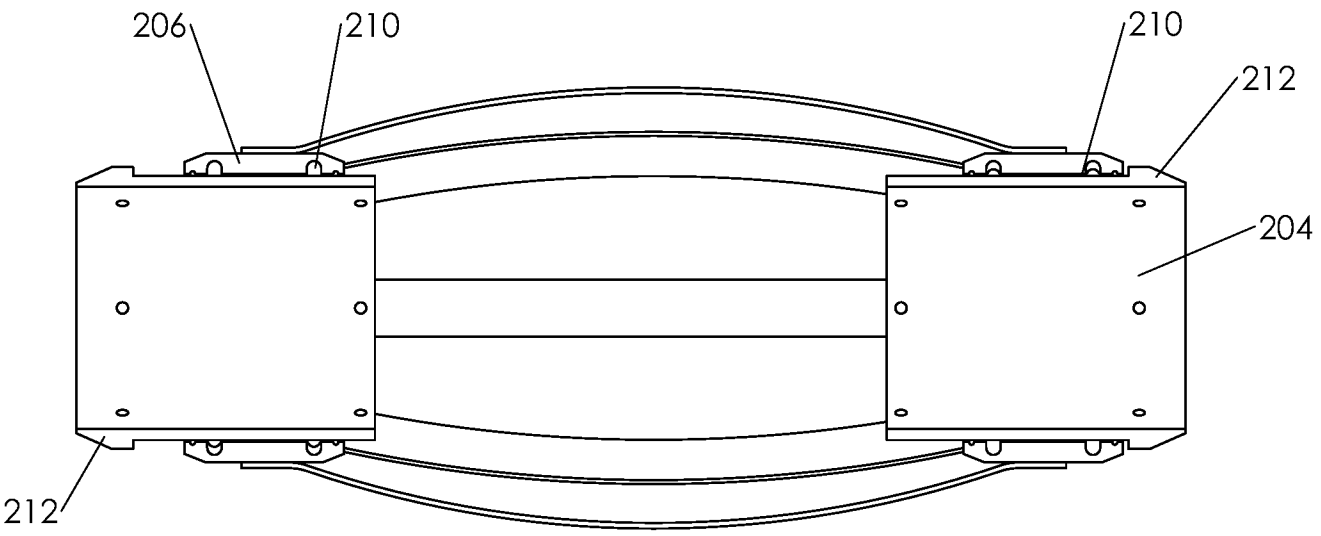
FIG. 8 is a cross sectional side view of the centraliser from FIG. 5 taken along Section J-J of FIG. 6.

The bands 206 are able to move relative to the respective sleeves 204, both in a rotational manner as well as longitudinally. Referring to FIG. 8, bearings 210 are located between the sleeves 204 and the bands 206. Specifically, ball bearings are seated in a groove on an inner surface of the bands 206. It will be appreciated, however, that it may be possible to use alternative forms of bearing in other embodiments. The bearings 210 used here, however, are advantageous as they allow relative travel in both directions as required.

The sleeves 204 each have a collar 212 to limit movement of the band 206 along the sleeve 204. This prevents the band 206 from moving too far and passing beyond the end of the sleeve 204.

The sleeves 204 also each have a number of through holes 214 in which grub screws can be fitted. This allows the sleeves 204 to be fitted over the tubing and secured in place by tightening the grub screws against the outer surface of the tubing. The holes 214 are located in the collar 212 so that grub screws do not interfere with movement of the bands 206 over the sleeves 204.

The centraliser 200 can be fitted to the tubing to hold the tubing in a central position within the casing. The deformable members 207 can press against the inside of the casing and provide a form of suspension, where vibrations can be permitted and absorbed, with the members 207 flexing as required. If necessary, the bands 206 can slide along the sleeves 204 in a longitudinal direction as the members 207 bend, resulting in their effective length changing.

Unlike known centralisers, however, the presently described embodiment still allows the tubing to be rotated within the casing. That is, the sleeves 204 can remain fixed to the tubing, with the body 205 remaining fixed relative to the casing, with these components able to rotate relative to one another thanks to the bearings 210 between the sleeves 204 and the bands 206.

The use of the sleeves 204 is important, as the outside surface of the tubing is not always created with sufficient tolerance to allow the bands 206 to be fitted directly to the tubing. Additionally, the collars 212 mean that the bands 206 can move in a longitudinal direction, but the extent of this movement can still be limited. Therefore, the present invention allows fitting of the centraliser 200 directly to any available tubing, but still retaining these benefits.

While the wellhead 100 and centraliser 200 could be used separately, it will be appreciated that a particularly advantageous well tubing system can be created by using these components together. That is, the wellhead 100 that can be used to rotate tubing that is suspended from this apparatus will operate very effectively when the tubing also uses the centralisers 200 that permit rotation of the tubing.

A well that uses this system can be operated for a period of time before then rotating the tubing. For example, the tubing may be rotated 180°, or any other suitable value that is not a complete revolution. This will result in any areas of increased wear in the tubing to be moved, so that a portion having experienced less wear is now in this position to be subject to the increased wear going forward. In this way, the life of the tubing can be increased.

The tubing may be rotated periodically, with the degree of rotation being chosen so that the wear to the walls of the tubing is distributed as evenly as possible.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "front" and "rear", "inner" and "outer", "above" and "below" and the like are used as words of convenience to provide reference points and are not to be construed as limiting terms.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers. As used herein and unless otherwise stated, the term "approximately" means±20%.

Persons skilled in the art will appreciate that numerous variations and modifications will become apparent. All such variations and modifications which become apparent to persons skilled in the art, should be considered to fall within the spirit and scope that the invention broadly appearing before described.

The invention claimed is:

1. A wellhead, comprising:

a) a casing head;

b) a tubing hanger; and c) a rotation assembly connected to the tubing hanger;

wherein the tubing hanger is rotatable relative to the casing head and this rotation is effected by the rotation assembly;

wherein the rotation assembly comprises a linear actuator that is pivotally connected to the tubing hanger in a manner that allows location of the connection to be adjusted around a circumference of the tubing hanger; and wherein the tubing hanger comprises a peripheral groove, and the rotation assembly comprises a tab that is inserted in the groove for connection of the rotation assembly to the tubing hanger.

2. The wellhead according to claim 1, wherein the rotation assembly is connected between the casing head and the tubing hanger.

3. The wellhead according to claim 1, wherein the tubing hanger has a plurality of holes for securing the tab of the rotation assembly in one of a plurality of positions within the groove.

4. The wellhead according to claim 1, wherein at least one of:

a) a bearing is disposed between the casing head and the tubing hanger; or b) a seal is disposed between the casing head and the tubing hanger.

5. The wellhead according to claim 1, wherein the tubing hanger comprises a conduit that extends through the tubing hanger and allows fluid communication through the tubing hanger to a void between a casing that is connected to the casing head and a tubing that is connected to the tubing hanger.

6. A well tubing system, comprising;

a) the wellhead according to claim 1;

b) a tubing suspended from the wellhead; and c) one or more centralisers fitted to the tubing, each centraliser comprising:

i) a first sleeve and a second sleeve;

ii) a body comprising a first band and a second band connected to one another by a plurality of resiliently deformable members, wherein the first band extends about the first sleeve and the second band extends about the second sleeve, and wherein the bands are able to move relative to the respective sleeves.

7. A method of operating a well, the well comprising casing, a wellhead connected to the casing, and tubing within the casing suspended from the wellhead, wherein the wellhead comprises a casing head, a tubing hanger, and a rotation assembly connected to the tubing hanger, wherein the tubing hanger is rotatable relative to the casing head and this rotation is effected by the rotation assembly the rotation assembly comprises a linear actuator that is pivotally connected to the tubing hanger in a manner that allows location of the connection to be adjusted around a circumference of the tubing hanger, the tubing hanger comprises a peripheral groove, and the rotation assembly comprises a tab that is inserted in the groove for connection of the rotation assembly to the tubing hanger, the method comprising steps of:

i) operating the well for a period of time; and ii) rotating the tubing.

8. The method according to claim 7, wherein the tubing is rotated periodically.

9. The method according to claim 7, wherein the step of rotating the tubing comprises substeps of:

i) extending the linear actuator of the rotation assembly that is pivotally connected to the tubing hanger;

ii) disconnecting the rotation assembly from the tubing hanger;

iii) contracting the linear actuator; and iv) reconnecting the rotation assembly to the tubing hanger.

10. The method according to claim 7, wherein the step of rotating the tubing comprises substeps of:

i) contracting the linear actuator of the rotation assembly that is pivotally connected to the tubing hanger;

ii) disconnecting the rotation assembly from the tubing hanger;

iii) extending the linear actuator; and iv) reconnecting the rotation assembly to the tubing hanger.

* * * * *